United States Patent [19]

Déglon et al.

[11] Patent Number: 4,912,375

[45] Date of Patent: Mar. 27, 1990

[54] ENERGIZING ARRANGEMENT FOR A DISCHARGE LAMP

[75] Inventors: Philippe Déglon; Werner Schneiter, both of Bienne, Switzerland

[73] Assignee: Omega Electronics S.A., Bienne, Switzerland

[21] Appl. No.: 210,967

[22] Filed: Jun. 24, 1988

[30] Foreign Application Priority Data

Jun. 26, 1987 [FR] France ..... 87 09109

[51] Int. Cl.[4] ..... G05F 1/00; H05B 37/02

[52] U.S. Cl. ..... 315/306; 315/107; 315/289; 315/205; 315/207; 315/208; 315/224

[58] Field of Search ..... 315/106, 107, 289, 290, 315/DIG. 7, 306, 205, 207, 208, 224

[56] References Cited

U.S. PATENT DOCUMENTS

| | | | |
|---|---|---|---|
| 3,890,537 | 6/1975 | Park et al. | 315/208 |
| 4,101,809 | 7/1978 | Morais | 315/156 |
| 4,649,322 | 3/1987 | Tellan et al. | 315/306 |
| 4,766,350 | 8/1988 | Husgen et al. | 315/207 |

FOREIGN PATENT DOCUMENTS 1366032 6/1964 France .

*Primary Examiner*—Eugene R. Laroche
*Assistant Examiner*—Thanh-Truc Nguyen
*Attorney, Agent, or Firm*—Griffin, Branigan & Butler

[57] ABSTRACT

A discharge lamp energizing arrangement comprises a starter and a generator adapted to maintain a discharge current in the lamp. The generator includes a first circuit arranged to couple in series a D.C. voltage source, a first switch and a second switch. When the first switch is closed the second is open and vice versa. A second circuit, arranged to couple an inductance and the lamp in series, is connected in parallel with the second switch. The switches are operated by a first control means which employs the signals received from an oscillator. The starter includes a third switch connected in parallel with the lamp terminals. The third switch is operated by a second control means itself operated by the first control means. When the energizing arrangement is turned on the third switch is closed and it subsequently reopens on the first occasion that the first switch passes from the closed to the open state.

9 Claims, 9 Drawing Sheets

ENERGIZING ARRANGEMENT FOR A DISCHARGE LAMP

BACKGROUND OF THE INVENTION

An arrangement close to the first embodiment has already been set forth in the document EP-A-0 152 026 (U.S. Pat. No. 4,649,322). In this the triggering of the discharge in the lamp is brought about by a first generator which provides voltage pulses at predetermined periodic intervals. The luminous intensity of the lamp is controlled by a current source provided by a second generator which permits applying to the lamp a maintenance current for the discharge, the duration of application of which may be varied according to the luminous intensity which it is desired to obtain. The arrangement as mentioned includes furthermore a circuit which enables application of the maintenance current in synchronism with the voltage pulse.

In addition to the two embodiments of the pulse generator, the cited document describes a manner for reducing to practice the generator for maintaining discharge in the lamp. This maintenance generator, which is a current source, is energized from a DC voltage source and includes essentially a cascade of two transistors which conduct continuously when an instruction signal is sent to the input of the first transistor. The duraction of the application of the instruction signal (which can be for instance a video signal) determines the period during which the current source conducts, such period being for instance on the order of 14 ms for a lamp operating at full luminosity, this period being followed by a series of periods of like duration if the lamp is to remain illuminated at this full luminosity. In the case where the arrangement as described were to be adapted to vary simply the luminous intensity of a fluorescent lighting lamp, for instance by means of a manual control, a single pulse would be necessary furnished by a pulse generator at the moment of lamp turn on, this pulse being followed by a DC current to remain continuously at the chosen level.

This manner of operation is costly in electrical energy which is dissipated as heat and thus as a pure loss. Effectively, it is said in the cited document that an energization voltage of 60 V DC enables assuring an arc voltage of about 40 V in the tube, this leading one to believe that there exists a voltage drop on the order of 20 V which must be absorbed in the current generator. In reality it will be noted that the arc voltage may vary in substantial proportions (10 to 60 V), depending in this on the dynamic load to which the lamp is subjected. The temperature has also an important influence on the value of the arc voltage. Thus, in the cited arrangement, it is the current generator formed from two transistors as hereinbefore mentioned which is to absorb the difference existing between the energization voltage and the arc voltage, such difference being dissipated as a pure loss as already said.

In order to overcome the cited disadvantages, the document FR-A-1 366 032 suggests an arrangement which is a current source without itself consuming current whatever be the load, such load here being manifested by the arc voltage essentially variable as exhibited by the lamp.

This prior art will now be explained having reference to FIGS. 1*a*, 1*b*, 1*c*, 2 and 3.

FIG. 1*a* is a general schematic which shows the basic priniple on which the document FR-A-1 366 032 rests.

A discharge lamp 1 which may be a fluorescent tube is provided with two electrodes 2 and 3. A first generator or starter 4 provides a voltage pulse adapted to bring about triggering of the discharge in the lamp. This first generator is however not mentioned in the cited document since the energization voltage $U_1$ is sufficiently high (on the order of 400 volts) to enable automatic triggering of the discharge in the lamp which, as will be seen further on, is not the case in the present invention in which said voltage is only on the order of 60 volts. In this case such first generator 4 could be one of those described in the document EP-A-0 152 026. FIG. 1*a* shows further a second generator adapted to maintain the discharge current in the lamp, such second generator includes a first electric circuit 5 which comprises the placing into series of a DC voltage source $U_1$, a first switch $I_1$ and a second switch $I_2$. Switches $I_1$ and $I_2$ are arranged in a manner such that when the first is open the second is closed and vice versa. This interdependence is shown on FIG. 1*a* by the dashed line 13 which couples the respective contact bars of said switches. The schematic further shows that at the terminals of the second switch $I_2$ there is connected a second dielectric circuit 6 which consists of the placing into series of an inductance L and of the discharge lamp 1.

Switch $I_1$ is operated by a control means 7. This control means is energized at its input 8 by an alternating signal of fixed period $T_1$. This signal has its period $T_1$ composed of an alternation of duration $T_2$ at high level followed by an alternation of duration $T_3$ at low level. The cyclic ratio of this signal is defined as being the ratio $T_2/T_1$. The alternating signal of fixed period $T_1$ is provided by an oscillator and the alternations $T_2$ and $T_3$ have a duration approximately equal.

FIG. 1*a* also shows that the control means 7 is arranged to provide at its output 15 a signal adapted to set alternately the first switch $I_1$ initially into a closed state during a first time interval of duration $T_a$, then into an open state during a second time interval of duration $T_b$, the sum $T_a+T_b$ being a function of the input period $T_1$.

The operation of this arrangement will now be explained having reference to FIGS. 1*b* and 1*c*.

During the first interval of duration $T_a$, $I_1$ is closed and $I_2$ is open as shown in FIG. 1*b*. Various source $U_1$ provides a current flow $i_1$ in the inductance L and the lamp 1 via switch $I_1$ (circuit 5). In view of the presence of inductance L and the resistance R of the lamp, the current $i_1$ will increase from a value neighboring zero to a maximum value determined at the ending of the interval of duration $T_a$. From this moment begins the second interval of duration $T_b$ during which $I_1$ is open and $I_2$ is closed. The situation of the electrical circuits 5 and 6 is then that shown on FIG. 1*c*. The electrical energy stored in the inductance L during the preceding phase then produces a current $i_2$ which via switch $I_2$ circulates in the lamp 1. The inductance L then behaves as a generator. In contrast to the current practice of certain known energization arrangements, this inductance is not a current limiter but acts as a current reservoir. The current $i_2$ will diminish during the interval of duration $T_b$ until the appearance of a new interval of duration $T_a$ which will once again close the switch $I_1$. From the end of the period $T_b$ a new cycle recommences with a similar sequence follows.

There has just been described the general principle on which is based the energizing arrangement according to document FR-A-1 366 032. In fact it concerns a current source which itself does not consume current and which furnishes only the energy necessary to bring about the luminous flux in the lamp. Effectively, the switches as described are either on or off and consume practically no energy themselves.

The basic arrangement has been explained in referring to switches $I_1$, $I_2$ operated by a control means. In practice there is employed a switching transistor in place of the switch $I_1$, such transistor being controlled on its base by the signal coming from the output 15 of the control means 7. Likewise in practice one may advantageously employ a diode to replace the switch $I_2$, such diode being connected so that it is non-conductive when the transistor is conductive. This diode presents the advantage of being self-controlled by the polarity of the voltage present at its terminals.

The schematic of FIG. 2 shows a manner of obtaining the energizing arrangement according to the prior art. The control arrangement here is a D type flip-flop (D-FF) the terminals Set and Reset of which are connected to −12 volts of the energization for the logic. The output $\overline{Q}$ of the flip-flop is connected to its D input. On its input 8 the flip-flop receives the alternating signal of fixed period $T_1$ likewise referred to as the clock signal (CL), this signal being provided by an oscillator 9. The transistor Ti1 is controlled on its base by the output Q of the flip-flop. The collector of the transistor Ti1 is connected to diode D1 and the emitter to the voltage source $U_1$. The operation of the construction which has just been described will now be explained having reference to the timing diagram shown on FIG. 3.

To the input 8 of the flip-flop is applied the clock signal CL, which appears on the line a of the diagram. This signal oscillates between −12 V and 0 V (0 V symbolized by the signal $\phi$) i.e. between the logic values 0 and E 1 respectively. This type of flip-flop (for instance CMOS 4013) has the particularity of placing its output Q at the value applied to its input D when the signal C1 goes from 0 to 1 (arrows 18), the passage from 1 to 0 in no manner changing the state of the output Q so long as the inputs Set and Reset are both at the 0 logic level (−12 V). Since the input D is coupled to the output $\overline{Q}$, the output Q will change state at each rising edge 18 of the clock signal as appears on line b of FIG. 3, the rising edge 18 driving the falling and rising edges 19 of the output Q (arrows 65).

The passage from 0 to −12 V of the output Q has as effect to place the transistor Til from the blocked state (switch $I_1$ open) to the conductive state (switch $I_1$ closed). A current $i_1$ begins to circulate in the circuit defined by FIG. 1*b*, such current having its rate of increase limited by the presence of the inductance L (see line c of the diagram of FIG. 3 which represents the current $i_1$ in lamp 1).

When the flip-flop once again switches, its output Q goes to 0 V and renders non-conductive the transistor Ti1. From this moment the energy stored in inductance L produces a current $i_2$ which circulates in the circuit 6 via the diode D1, this current diminishing since no voltage source continues to be applied thereto (see line c of FIG. 3). This current $i_2$ diminished until the transistor Ti1 becomes once again conductive which take place at the arrival of a new rising edge 18 presented by the signal $T_1$ at the input CL of the flip-flop. The cycle which has just been described in detail then continues in the same manner.

Thus the alternating signal of fixed period $T_1$ applied to the input CL of the flip-flop and composed of two equal alternations $T_2$ and $T_3$ becomes seen from the lamp 1 a signal of double period and composed of two alternations $T_a$ and $T_b$ of durations approximately equal.

The diagram of FIG. 3 has been completed by a line d which represents the current $I_{D1}$ in the diode D1. It will be noted that during the period of conductive $T_a$ of transistor $Ti_1$ no current circulates in the diode while during the blocking period $T_b$ of the same transistor a current $i_2$ circulates in said diode.

The diagram of FIG. 3 shows further a current threshold $I_L$ min below which the current in the lamp does not fall. This caused by the fact that the inductance L is not totally discharged when cycle $T_1$ recommences.

Although not specifically mentioned in the cited prior art, lamp 1, which most often is a fluorescent lamp, has a cold anode 2 and a hot cathode 3. This cathode is a filament energized by a DC source $U_5$. Considerations have been set forth in the document EP-A-0 152 026 on the subject of this energization and the reader may refer thereto for greater detail.

SUMMARY OF THE INVENTION

To trigger discharge in the illumination lamp 1, one may employ in the document FR-A-1 366 032 on a DC voltage $U_1$ exceeding 400 volts. This has the disadvantage of requiring high voltage circuits which give rise to insulation problems and at the same time necessitating burdensome components (transistors, diodes, etc.). To overcome this difficulty, the present invention is characterized in accordance with a first embodiment in that the generator adapted to trigger the discharge in the lamp, includes a third switch connected in parallel across the terminals of the lamp and operated by a second control means itself operated by the first control means, such second control means being arranged in a manner such that said third transistor is closed at the start up of said energizing arrangement and then opens on the first occasion that said first switch passes from the closed state to the open state.

In the same manner, to employ a DC voltage source specifically to energize the lamp filament is a solution expensive in energy. To overcome this difficulty the present invention is characterized in that the second generator includes a first electric circuit comprising the setting into series of a DC voltage source, a first switch and a second switch, said first and second switches being arranged in a manner such that when the first is closed the second is open and vice versa and the second electric circuit comprising the setting into series of an inductance, of the first cold electrode and of a first terminal of said filament, said second electric circuit being connected in parallel across the second switch, a third switch being connected on the one hand to said first cold electrode and on the other hand to a second terminal of said filament, that said first and second switches are operated by a first control means energized by an alternating signal of fixed period $T_1$, said control means being arranged to provide at its output a signal adapted to alternately set said first switch initially in a closed state during a first time interval of duration $T_a$, then into an open state during a second time interval of duration $T_b$ and that the third switch is operated by a second control means itself operated by said first control means, said second control means being arranged in a manner such that the third switch closes at the start up of said energizing arrangement then opens following a period $T_d$, said opening taking place on the first occasion that said first switch goes from the closed state to the open state following said time interval of duration $T_d$.

The invention will be better understood with the help of the description to follow and for understanding of which reference will be made by way of example to the drawings in which:

DESCRIPTION OF THE PREFERRED EMBODIMENT

Figure 4:
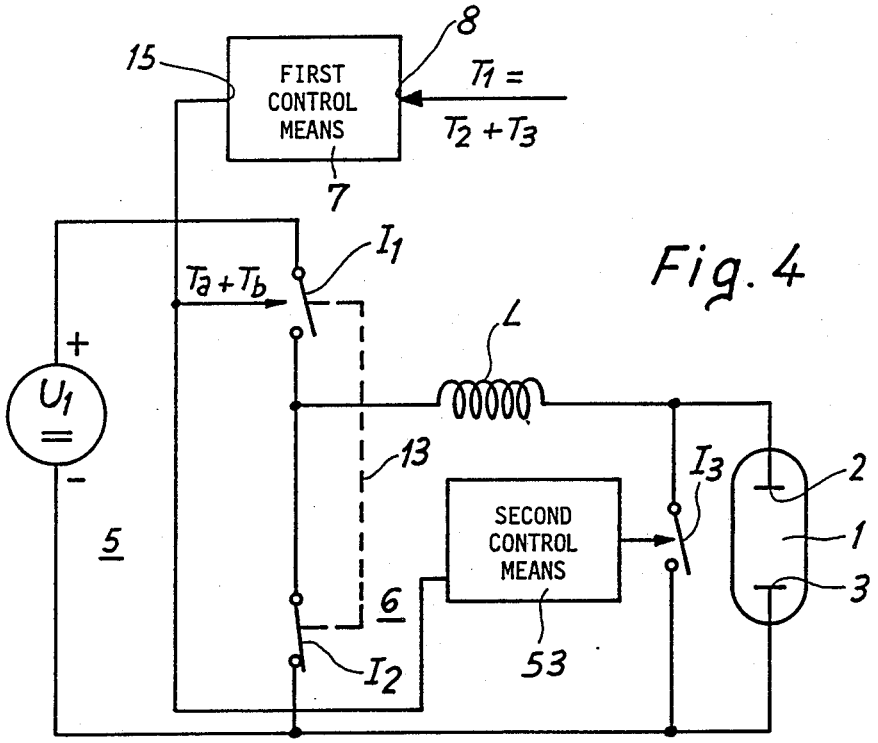
FIG. 4 is a schematic showing the principle and setting forth the operation of the energizing arrangement according to the first embodiment of the invention.

FIG. 4 is a schematic of the principle showing the operation of the energizing arrangement according to the first embodiment of the invention.

Figure 1A:
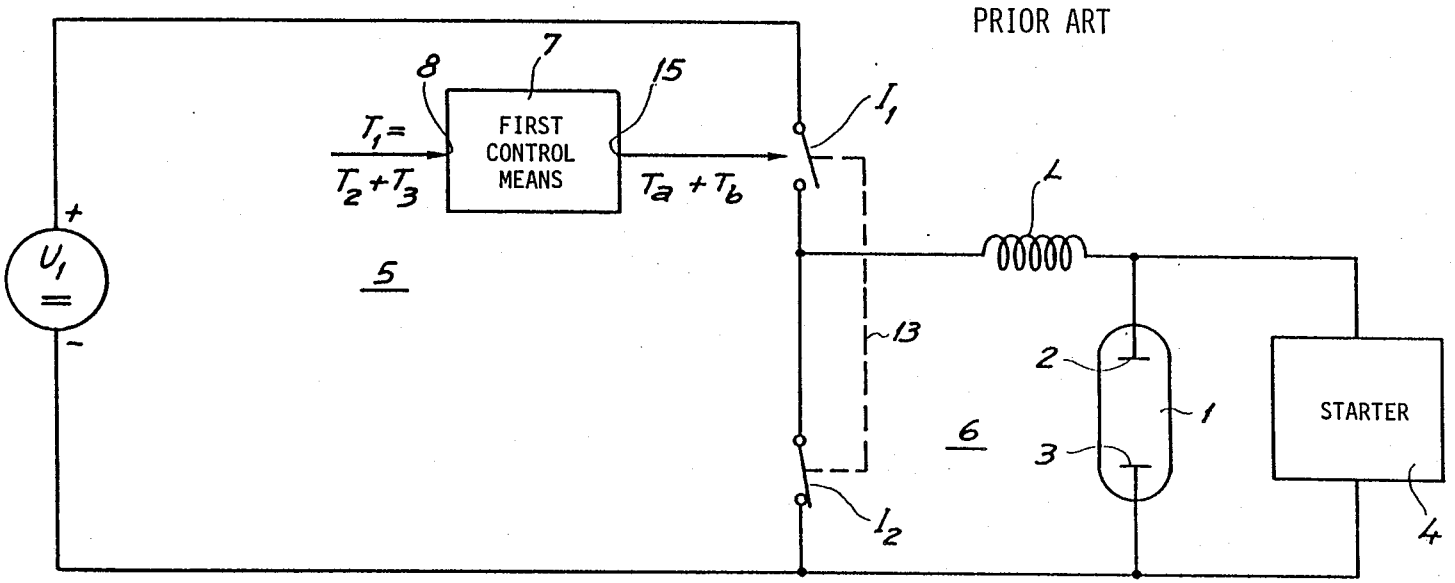
FIGS. 1*a*, 1*b*, 1*c*, 2 and 3 illustrate the prior art as discussed hereinabove.
Figure 1B:
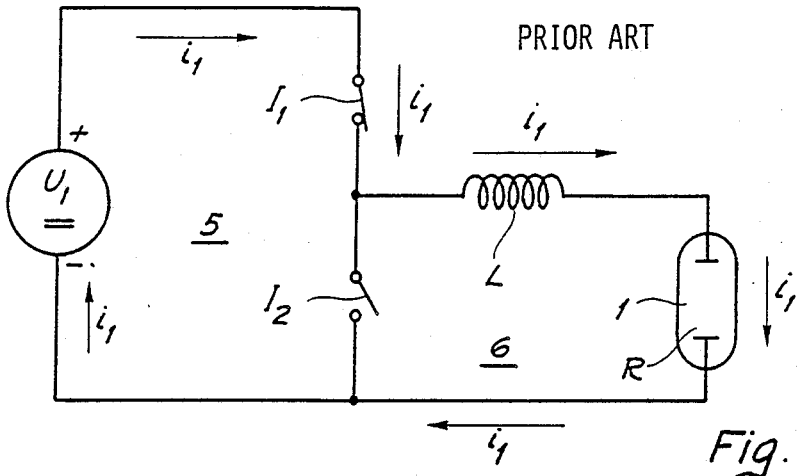
Figure 1C:
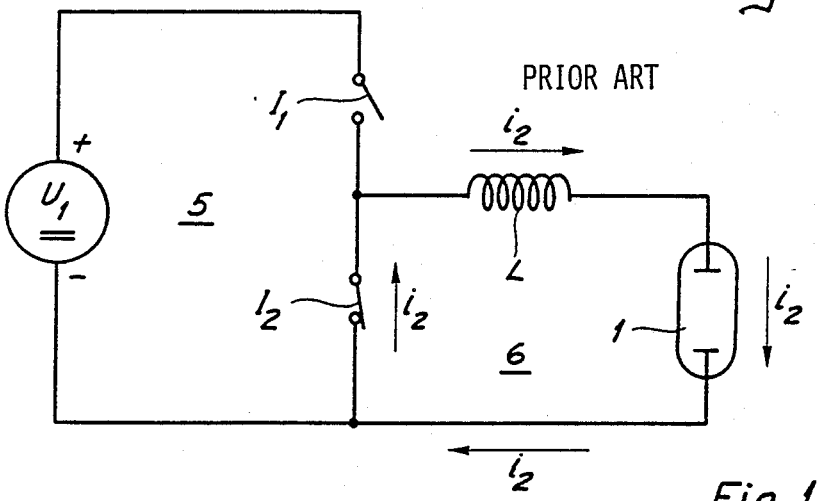

It has already been mentioned hereinabove that the DC voltage source $U_1$ energizing the arrangement according to the invention is at low voltage, for instance on the order of 60 volts. It is know that this voltate is insufficient to trigger discharge in the lamp. It is thus necessary to apply a high voltage pulse to the lamp at the moment when the system is turned on. This pulse is provided by a starter or first generator symbolized by 4 on FIG. 1*a*.

According to the invention and as appears on FIG. 4, the high voltage pulse adapted to trigger discharge is produced by a third switch $I_3$ connected in parallel across terminals 2, 3 of the lamp 1. This switch is controlled by a second control means 53 itself operated by a first control means 7 already described having reference to FIG. 1*a*. It is arranged so that at the turn on of the energizing arrangement this third switch is closed. Since, at this moment, the first switch $I_1$ is likewise closed, inductance L stores energy as has been explained hereinabove. The opening of switch $I_3$ synchronous with the opening of switch $I_1$ in view of the interdependence of the first and second control means 7 and 53, liberates the energy stored in the inductance and creates the high voltage required at the terminals of the lamp. A detailed explanation of the operation of the starter will be given in the discussion which will be made having regard to the second embodiment of the invention.

Figure 2:
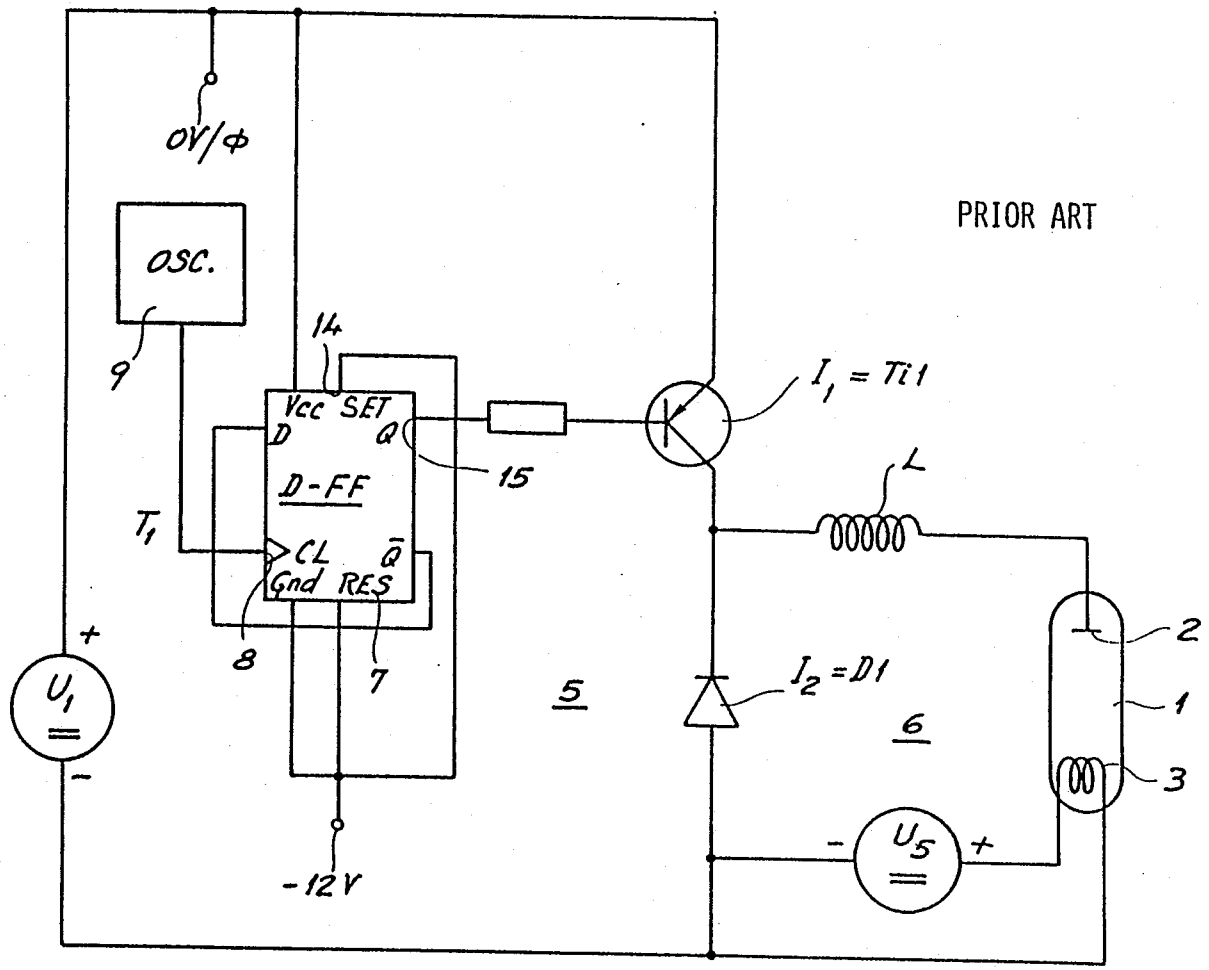

However, in résumé, it may be mentioned that the first control means 7 is identical to that described on FIG. 2 wherein such means is a D-type flip-flop. The second control means 53 is a second flip-flop of the same type energized at its clock input CL by the signal present at the output Q of the first flip-flop. The signal present at the output Q of the second flip-flop controls the third switch $I_3$ which may be a third transistor Ti3.

To give now a practical example it will be mentioned that the transistor Ti1 is of the type 2N5400 and the diode D1 of the type 1N4148. The voltage source $U_1$ is 60 V. It will be observed here that the inductance employed is of very small dimensions (some $mm^3$) which is an advantage due principally to the fact that the alternating signal of fixed period $T_1$ is chosen to be of high frequency, for instance greater than 150 kHz.

The first embodiment of the invention which has just been described employs a flip-flop 7 connected to be a divide-by-two frequency divider. One thus has in this case $T_a+T_b=2T_1$. In other words, if one wishes the transistor to switch at a frequency of 150 kHz, it will be necessary to energize the flip-flip at double this frequency, i.e. at 300 kHz. In any case, the schematic shows that the period of conduction $T_a$ of the transistor Ti1 is equal to the open period $T_b$ of the same transistor.

The second embodiment concerns in particular the energization of a discharge lamp equipped with a filament.

Figure 5:
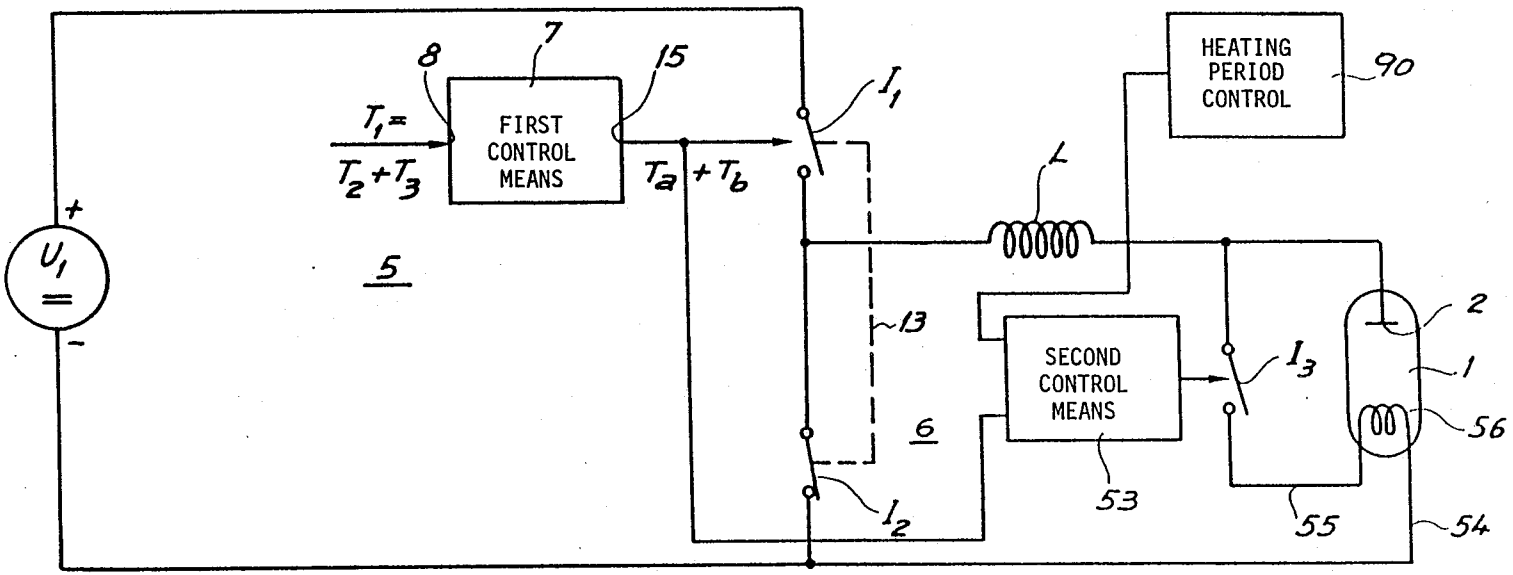
FIG. 5 is a schematic showing the principle and setting forth the operation of the energizing arrangement according to a second embodiment of the invention.

The base schematic of a first principal variant of the invention is shown on FIG. 5. Here there will be recognized the maintenance current generator formed by the first 5 and second 6 electric circuits described hereinabove. Lamp 1 is equipped with a first cold electrode 2 and a second electrode provided with a filament 56. According to this embodiment, the second generator of this construction formed from circuits 5 and 6 serves at the same time to heat the filament and to maintain discharge in the lamp.

Figure 3:
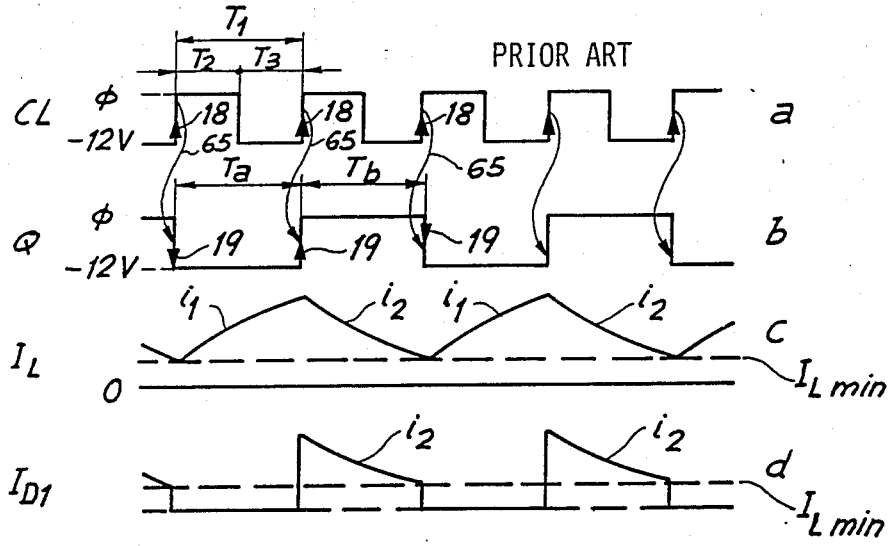

To this end the second electric circuit 6 includes the setting into series of the inductance L, the first cold electrode 2 and a first terminal 54 of filament 56. This second circuit is connected in parallel across the second switch $I_2$. FIG. 5 further shows a third switch $I_3$ connected on one hand to the cold electrode 2 and on the other to a second terminal 55 of the filament 56. The third switch $I_3$ is operated by a second control means 53, itself operated by the first control means 7. The second control means 53 is arranged in manner such that at the start up of the energizing arrangement (by a general switch not shown) the third switch $I_3$ closes. The filament 56 is then energized by the second generator 56 according to the same principle explained hereinabove. Energization of the filament takes place during a period of duration $T_d$ provided by the block 90 acting on an input of the second control means 53. This heating period will last the time necessary to render the filament incandescent. When the heating period which is fixed, has run out, the third switch opens, this opening taking place on the first occasion that the first switch $I_1$ goes from the closed state to the open state following the period of duration $T_d$. This change of state is exhibited in the form of a logical signal at the output 15 of the first control means 7. This same logic signal acts on the second control means 53 and opens the switch $I_3$. As it is found that at the moment of opening of the first switch the energy stored in the inductance L is maximum and corresponds to a maximum current $I_1$ in the lamp (see FIG. 3*c*), the opening of the third switch $I_3$ which is synchronous with the first brings about a high voltage in the lamp, this high voltage causing triggering of the discharge. Following this, the third switch $I_3$ remains open and the lamp 1 is energized in maintenance current by the second generator 5, 6.

Figure 6:
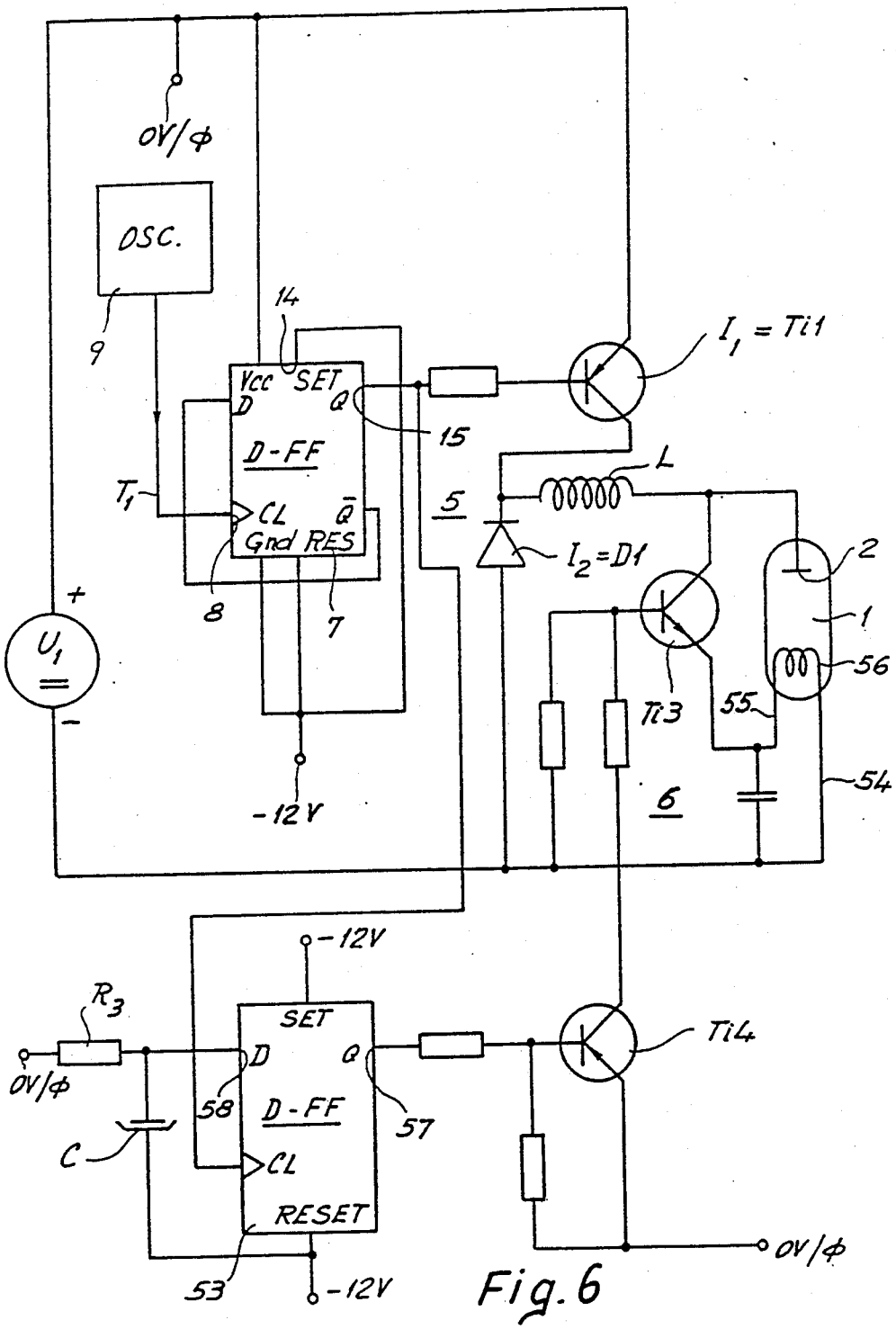
FIG. 6 is a detailed schematic of the energization of a discharge lamp which refers to the basic schematic of FIG. 5 according to a first practical variant.

FIG. 6 is a detailed schematic of a first variant of the second embodiment explained hereinabove in its principle. There will here be described the new elements added to those of FIG. 2. The third switch $I_3$ is a second transistor Ti3 which is controlled by the signal present at the output Q 57 of the control means 53 which is a second D-type flip-flop. The output Q 15 of the first flip-flop 7 is connected to the input CL of the second flip-flop 53. The input D 58 of the second flip-flop is coupled to 0 volts of the logic energization via a resistance $R_3$ and a capacitor C is connected between this input D and the −12 volts of the logic energization. The terminals Set and Reset of the second flip-flop are likewise coupled to −12 volts. An amplifier-inverter present in the form of a transistor Ti4 is interposed between the output Q57 and the base of the transistor Ti3. The purpose thereof is to amplify the signal present at the output Q and to invert it at the same time. The second transistor Ti3 has its collector connected to the cold electrode 2 of the lamp and its emitter connected to the second terminal 55 of the filament 56 of said lamp.

Figure 7:
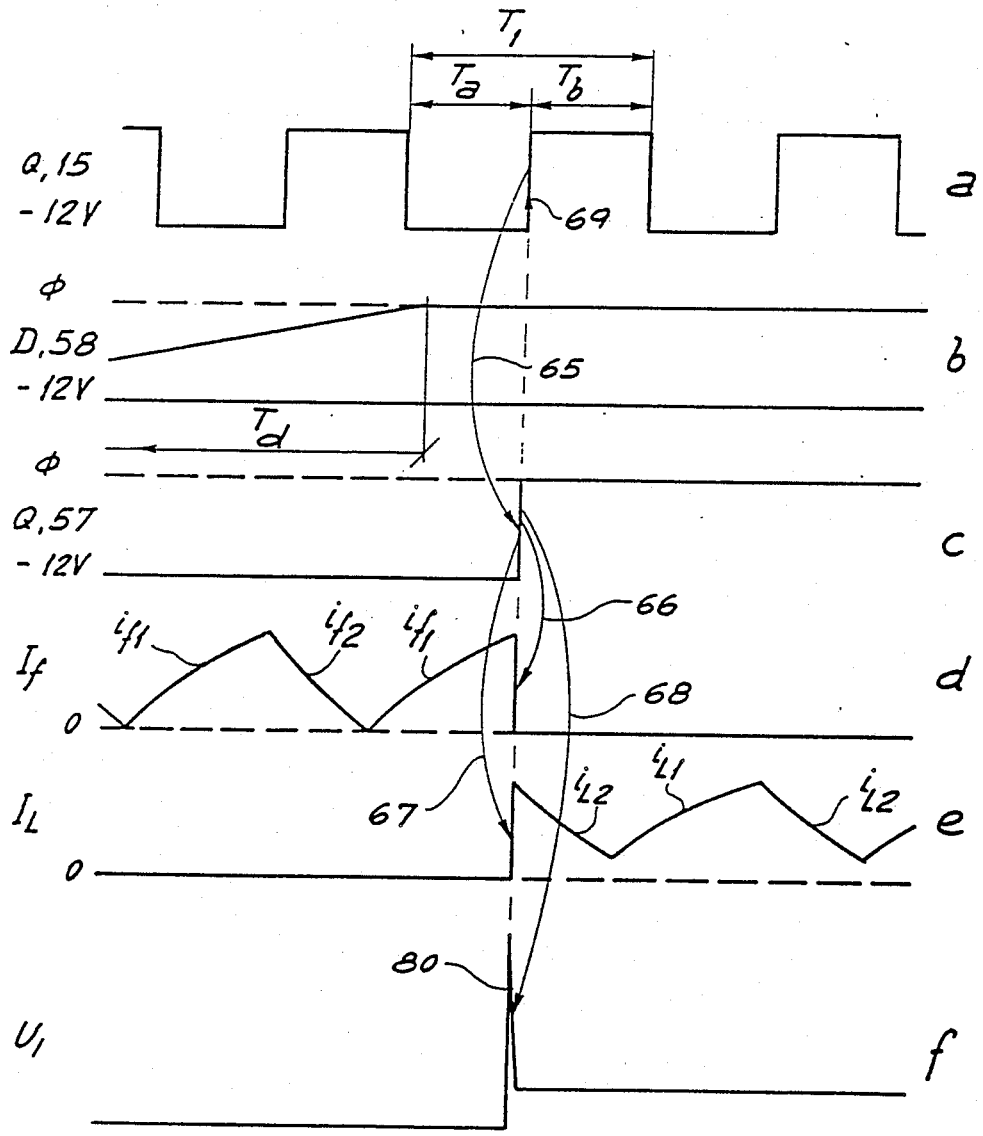
FIG. 7 is a timing diagram explaining the operation of the schematic of FIG. 6.

To explain the operation of the circuit of FIG. 6 reference will be made to the timing diagram of FIG. 7.

At the start up of the system, for instance by means of a switch (not shown) the input D 58 of the flip-flop 53 is at the logic level 0 (−12 V). The output Q 57 of the flip-flop 53 is likewise at the 0 level, the transistor Ti4 conducts and provides a base current to the transistor Ti3 which likewise conducts. The filament 56 is then under tension and is energized by the same second generator 5, 6 which has been described hereinabove (see FIG. 7*a*). The current $I_f$ in the filament is composed of a succession of currents $i_{f1}$ provided by the circuit 5 and currents $i_{f2}$ provided by the circuit 6 (see the beginning of FIG. 7*d*). The lamp 1 is then short-circuited by Ti3 and the voltage $U_1$ between terminals 2 and 55 is nul (see beginning of FIG. 7*f*). Following turn on of the system, the input D 58 of the flip-flop 53 is brought progressively from −12 V to 0 V and this during an interval of duration $T_d$ which is predetermined by the time constant $R_3C$ and which is calculated to be sufficient to bring the filament to incandescence (see beginning of FIG. 7*b*). At the end of the period $T_d$ the input D 58 of the second flip-flop is found to be at level 1 (0 V). From this moment it is understood that the next rising edge 69 applied to the input CL of the second flip-flop (and coming from the output Q15 of the first flip-flop 7) causes the output Q 57 of said second flip-flop (arrow 65) to switch and pass to 1 (0 V). At this instant the transistor Ti3 opens and the current $I_f$ in the filament 56 is interrupted (arrow 66). The opening of the transistor Ti3 brings about a high voltage 80 (FIG. 7*f*, arrow 68) at the lamp terminals this high voltage being due to the energy stored in the inductance L and which is liberated to bring about triggering of the arc. The switching of the output Q 57 of the second flip-flop which brings about opening of transistor switch Ti3 also leads the second generator 5, 6 to energize the terminals 2,56 of the lamp by a current $i_1$ (FIG. 7*c*, arrow 67) formed as already described by an alternation of two currents $i_{L1}$ and $i_{L2}$. Following the high voltage pulse 80, a maintenance voltage $u_1$ is established at the terminals of the lamp (end of FIG. 7*f*).

Thus in this second embodiment there is employed the same second generator to energize initially the filament in the lamp during a certain time, then to maintain the arc voltage in this lamp. This sytem leads to the employment of means which are considerably less expensive and cumbersome than the well-known heavy ballast which today is employed to energize fluorescent tubes employed for lighting purposes.

An assembly very similar to that which has just been described may be employed to put into practice the first embodiment of the invention which was explained having reference to FIG. 4. In this case the input D 58 of the flip-flop 53 should be connected to level 1 (0 V).

In the assembly which has just been examined (FIG. 6), the interval of duration $T_d$ during which the filament is energized is a period predetermined by a fixed time constant. One may however image that it could be the voltage developed at the terminals of the filament which itself determines this interval $T_d$. There will thus be described now a second practical variant which is based on the same principle schematic shown on FIG. 5. Reliance will be placed on FIG. 8 and on the diagram of FIG. 9 in order to discuss this second variant.

Figure 8:
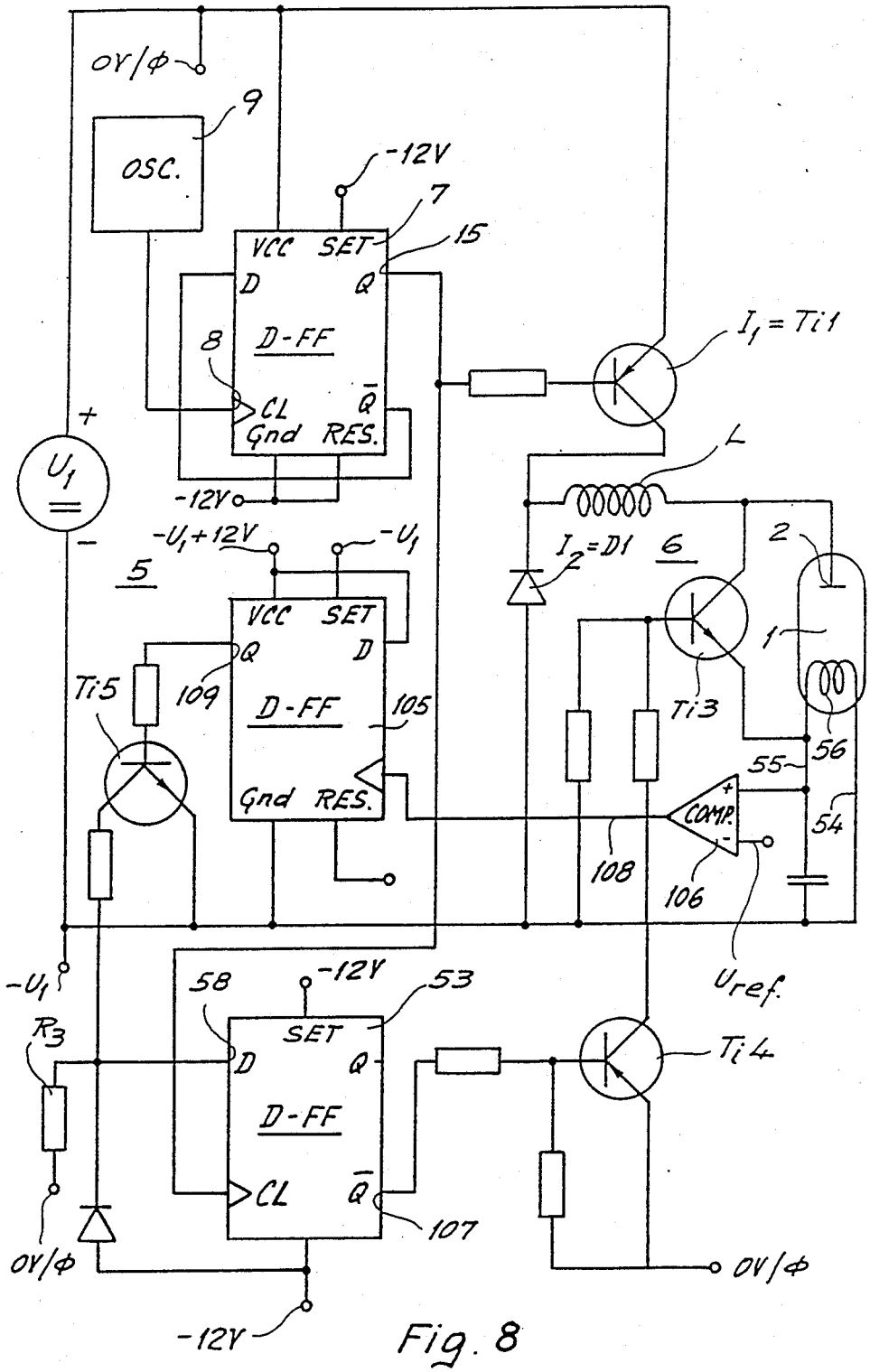
FIG. 8 is a detailed schematic of the energizing of a discharge lamp which refers back to the basic schematic of FIG. 5 according to a second practical variant.

FIG. 8 is a detailed schematic of the second variant. Relative to the first variant (FIG. 6), this assembly differs essentially by the addition of a comparator 106 and of a third D-type flip-flop 106 and by the elimination of the time constant $R_3C$. Terminal 55 of lamp 1 is connected to the + of the comparator 106, the terminal − of this comparator receiving a reference voltage $U_{ref}$. The output 108 of the comparator is connected to the input C1 of the third flip-flop 105. The D input of this flip-flop is connected to the 1 logic level (on this occasion to the voltage $-V_1+12$ V). The output Q 109 is connected to the D input of the second flip-flop 53 via a transistor Ti5 acting at the same time as inverter and voltage converter. In this second variant it is the output $\overline{Q}$ 107 of the second flip-flop which is connected to the transistor Ti4.

Figure 9:
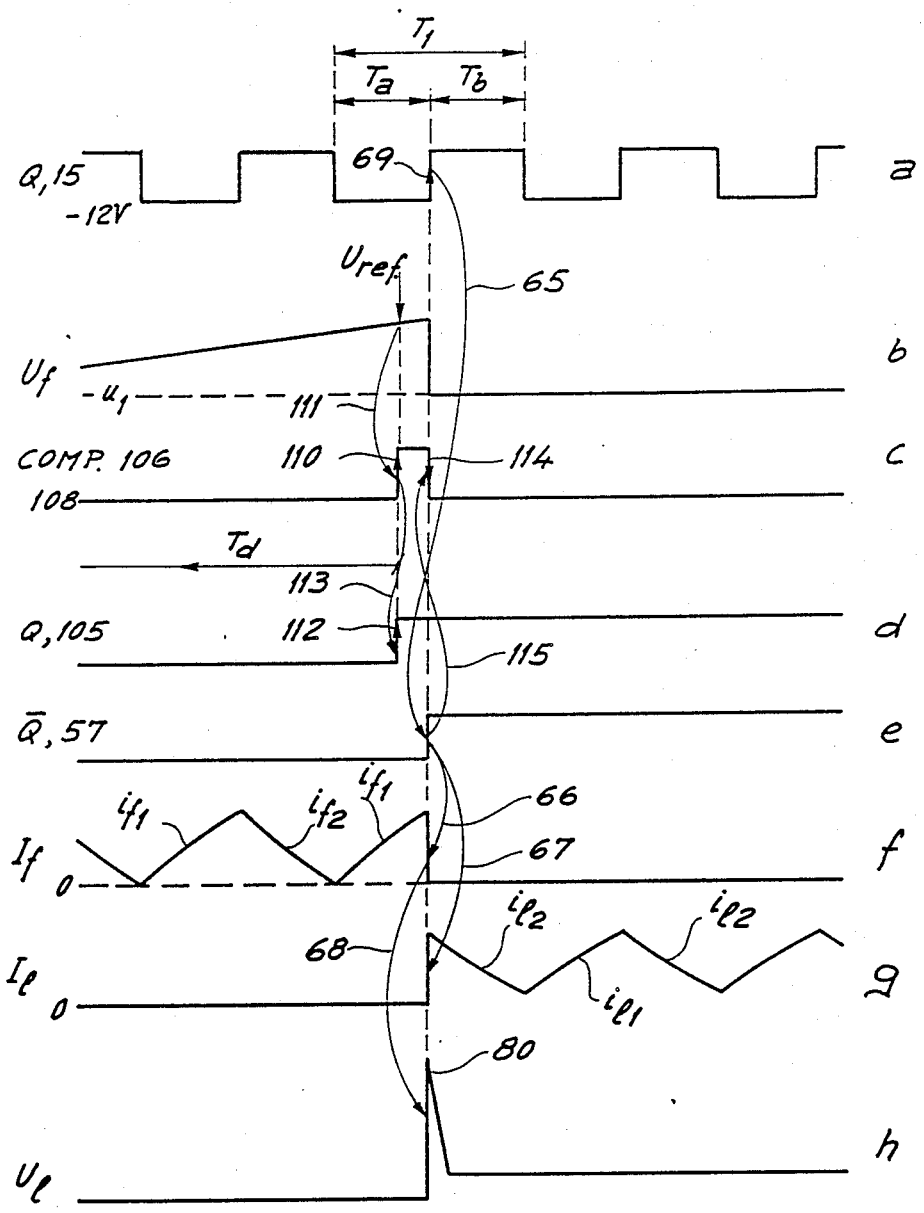
FIG. 9 is a timing diagram explaining the operation of the schematic of FIG. 8.

To explain the operation of the circuit of FIG. 8, reference will be made to the timing diagram of FIG. 9.

At the start up of the system, for instance by means of a switch (not shown) the input D 58 of the flip-flop 53 is at the 1 logic level (0 V). The output $\overline{Q}$ 107 of flip-flop 53 is thus at logic level 0, the transistor Ti4 conducts and provides a base current to the transistor Ti3 which likewise conducts. The filament 56 is then under tension and is energized by the same second generator 5, 6 which has been described hereinabove (see FIG. 9*a*). The current $I_f$ in the filament is comprised of a succession of currents $i_{f1}$ provided by the circuit 5 and the currents $i_{f2}$ provided by the circuit 6 (see beginning of FIG. 9*f*). Lamp 1 is then short-circuited by Ti3 and the voltage $U_1$ between the terminals 2 and 56 is nul (see beginning of FIG. 9*h*). Voltage $U_f$ across filament 56 between terminals 54 and 55 increase progressively as is shown by line b of FIG. 9. This increase is due to the increase of the resistance of the filament which is a consequence of its heating. When the voltage $U_f$ has attained a reference value $U_{ref}$ which may be fixed and which corresponds to full energization of the filament, output 108 of the comparator 106 passes from the low level to the high level indicated by the rising edge 110 (arrow 111, FIG. 9*c*). The edge 110 brings about in turn switching of the flip-flop 105 and passage of the output Q 109 from the low level to the high level, this effecting the rising edge 12 (arrow 113, FIG. 9*d*) since the D input of the flipflop 105 is at the 1 logic level. From this amount it is understood that the next rising edge 69 applied to the input CL of the second flip-flop 53 (and coming from the output Q 15 of the first flip-flop 7) brings about switching of the output $\overline{Q}$ 107 of said second flip-flop (arrow 65, line e of FIG. 9) which goes to the 1 logic level. At this instant the transistor Ti3 becomes non-conductive and the current $I_f$ in the filament 56 is interrupted (arrow 66, line f of FIG. 9). As has already been explained having reference to the first variant, the opening of transistor Ti3 causes application of a high voltage 80 (FIG. 9*h*, arrow 68) at the lamp terminals, this high voltage being due to the energy stored in the inductance L and which is liberated to bring about triggering of the arc. The switching of the output $\overline{Q}$ 107 of the second flip-flop which brings about opening of the transistor Ti3 also leads second generator 5, 6 to energize the terminals 2, 54 of the lamp by a current $I_1$ (FIG. 9*g*, arrow 67) formed as already described by an alternation of two currents $i_{L1}$ and $i_{L2}$. Following the high voltage pulse 80 a maintenance voltage $U_1$ is then established at the lamp terminals (end of FIG. 9*h*). It will be further noted that the interruption of energization of the filament brings about the falling edge 114 of the output signal 108 of the comparator 106 (FIG. 9*c*, arrow 115). The passage of this signal to the low level however has no influence on the third flip-flop 105 which reacts only to rising edges on its input C1 in a manner such that its output Q 109 remains at high level (FIG. 9). In this manner the third flip-flop stores in memory the fact that the lamp is illuminated and there is no longer need to re-energize its filament. Were such to be the case following for instance an energization breakdown, one could then reactivate the reset input of the third flip-flop 105.

In conclusion, it will be noted by way of example that the reference voltage $U_{ref}$ may be chosen to be 12 volts and the comparator may be of the type 74C909.

What we claim is:

1. An energizing arrangement for a discharge lamp comprising a first generator capable of providing a voltage pulse adapted to trigger discharge in the lamp and a second generator adapted to maintain a discharge current in the lamp, the second generator including a first electric circuit so arranged as to couple in series a D.C. voltage source, a first switch and a second switch, said first and second switches being arranged in a manner such that when the first switch is closed the second is open and vice versa and a second electric circuit, so arranged as to couple an inductance and said lamp in series, connected in parallel across said second switch, said switches being operated by a first control means energized by an alternating signal having a fixed period $T_1$, said first control means being arranged to provide a signal at its output adapted to set alternately the first switch intially into a closed state during a first time interval $T_a$ then into an open state during a second time interval $T_b$, said first generator including a third switch connected in parallel with the lamp terminals and operated by a second control means itself operated by said first control means, said second control means being so arranged that said third switch is closed when the energizing arrangement is turned on and subsequently opens on the first occasion that said first switch passes from the close to the open state.

2. An energizing arrangement as set forth in claim 1 wherein the first switch comprises a first transistor controlled by the first control means, the second switch comprises a diode connected so as to be non-conductive when the first switch is closed, the first control means comprises a D type flip-flop energized on its clock input by the alternating signal of period $T_1$ obtained from an oscillator, the first transistor being controlled on its base by the Q output of said flip-flop, the collector and emitter of said transistor being connected respectively to the diode and the voltage source, the terminals $\overline{Q}$ and D of said flip-flop being interconnected, the third switch comprising a second transistor controlled by the second control means, the second control means comprises a second D type flip-flop energized on its clock input by the signal present at the Q output of the first flip-flop and the second transistor being controlled by the signal present at the Q output of said second flip-flop.

3. An energizing arrangement for a discharge lamp having a first cold electrode and a second electrode provided with a filament, said arrangement comprising a first generator capable of providing a voltage pulse adapted to trigger discharge in the lamp and a second generator adapted to heat the filament during a period of duration $T_d$ then to maintain a discharge current in the lamp, said second generator including a first electric circuit arranged to couple in series a first DC voltage source, a first switch and a second switch, said first and second switches being arranged in a manner such that when the first switch is closed the second switch is open and vice versa and a second electric circuit arranged to couple in series an inductance, the first cold electrode and a first terminal of said filament, said second electric circuit being connected in parallel with said second switch, a third switch being connected on the one hand to said first cold electrode and on the other hand to a second terminal of said filament, said first and second switches being operated by a first control means energized by an alternating signal having a fixed period $T_1$, said first control means being arranged to provide a signal at its output adapted to set alternately said first switch initially into a closed state during a first time interval $T_a$ then into an open state during a second time interval $T_b$, and said third switch being operated by a second control means itself operated by the first control means, said second control means being so arranged that said third switch closes when the energizing arrangement is turned on and then reopens following said period $T_d$ said reopening taking place on the first occasion that said first switch passes from the closed to the open state following said period $T_d$.

4. An energizing arrangement as set forth in claim 3 wherein the period of duration $T_d$ is predetermined.

5. An energizing arrangement as set forth in claim 3 wherein the period of duration $T_d$ is defined by a comparator which receives the voltage developed across the terminals of the filament on its first input and a reference voltage on its second input, the period of duration $T_d$ ending when said voltages becomes equal.

6. An energizing arrangement as set forth in claim 3 wherein the first switch comprises a first transistor controlled by the first control means, the second switch comprises a diode connected so as to be non-conductive when the first switch is closed and the third switch comprises a second transistor controlled by the second control means.

7. An energizing arrangement as set forth in claim 6 wherein the first control means is a first D type flip-flop energized at its clock input by the alternating signal of period $T_1$, the first transistor being controlled at its base by the Q output of said first flip-flop, the collector and emitter of said first transistor being connected respectively to the diode and to the voltage source, the second control means comprising a second D type flip-flop energized on its clock input by the signal present at the Q output of said first flip-flop, said period of duration $T_d$ being present in the form of a signal corresponding to the D input of said second flip-flop and the second transistor being controlled by the signal present at the Q output of said second flip-flop via an amplifier-inverter, the collector and emitter of said second transistor being respectively connected to the first cold electrode and to the second termonal of said filament of said lamp.

8. An energizing arrangement for a discharge lamp comprising a first generator capable of providing a voltage pulse adapted to trigger discharge in the lamp, said first generator comprising a D.C. voltage source, a first switch and an inductance connected in series and to said lamp; and a second generator adapted to maintain a discharge current in the lamp, the second generator including a first electric circuit so arranged as to couple in series, said D.C. voltage source, said first switch and a second switch, said first and second switches being arranged in a manner such that when the first switch is closed the second is open and vice versa and a second electric circuit, so arranged as to coupled said inductance and said lamp in series, connected in parallel across said second switch, said switches being operated by a first control means energized by an alternating signal having a fixed period $T_1$, said first control means being arranged to provide a signal at its output adapted to set alternately the first switch initially into a closed state during a first time interval $T_a$ then into an open state during a second time interal $T_b$, said first generator including a third switch connected in parallel with the lamp terminals and operated by a second control means itself operated by said first control means, said second control means being so arranged that said third switch is closed when the energizing arrangement is turned on and subsequently opens on the first occasion that said first switch passes from the closed to the open state.

9. An energizing arrangement for a discharge lamp having a first cold electrode and a second electrode provided with a filament, said arrangement comprising a first generator capable of providing a voltage pulse adapted to trigger discharge in the lamp, said first generator comprising a D.C. voltage source, a first switch and an inductance connected in series and to said lamp; and a second generator adapted to heat the filament during a period of duration $T_d$ then to maintain a discharge current in the lamp, said second generator including a first electric circuit arranged to couple in series said first D.C. voltage source, said first switch and a second switch, said first and second switches being arranged in a manner such that when the first switch is closed the second switch is open and vice versa and a second electric circuit arranged to couple in series said inductance, said first cold electrode and a first terminal of said filament, said second electric circuit being connected in parallel with said second switch, a third switch being connected on the one hand to said first cold electrode and on the other hand to a second terminal of said filament, said first and second switches being operated by a first control means energized by an alternating signal having a fixed period $T_1$, said first control means being arranged to provide a signal at its output adapted to set alternately said first switch initially into a closed state during a first time interval $T_a$ then into an open state during a second time interval $T_b$, and said third switch being operated by a second control means itself operated by the first control means, said second control means being so arranged that said third switch closes when the energizing arrangement is turned on and then reopens following said period $T_d$ said reopening taking place on the first occasion that said first switch passes from the closed to the open state following said period $T_d$.

* * * * *